US007843477B2

(12) United States Patent
Yang

(10) Patent No.: US 7,843,477 B2
(45) Date of Patent: Nov. 30, 2010

(54) THERMAL SUBLIMATION CARD PRINTERS AND ASSOCIATED METHOD FOR PRINTING IMAGE ONTO CARD

(75) Inventor: Hsing-Lun Yang, Taipei (TW)

(73) Assignee: HiTi Digital, Inc., Taipei (TW)

( * ) Notice: Subject to any disclaimer, the term of this patent is extended or adjusted under 35 U.S.C. 154(b) by 982 days.

(21) Appl. No.: 11/625,830

(22) Filed: Jan. 23, 2007

(65) Prior Publication Data

US 2008/0113092 A1 May 15, 2008

(30) Foreign Application Priority Data

Nov. 14, 2006 (TW) ..... 95142059 A

(51) Int. Cl.
*B41J 2/325* (2006.01)

(52) U.S. Cl. ..... 347/213

(58) Field of Classification Search ..... 347/213, 347/214–215, 217–218, 221–222, 191, 193, 347/188, 171, 172, 716, 19; 400/120.01, 400/120.02, 120.04, 105, 237, 240
See application file for complete search history.

(56) References Cited

U.S. PATENT DOCUMENTS

| | | | | |
|---|---|---|---|---|
| 5,959,278 | A | 9/1999 | Kobayashi | |
| 6,222,575 | B1 | 4/2001 | Liu | |
| 6,796,732 | B2 | 9/2004 | Kobayashi | |
| 6,873,348 | B1 * | 3/2005 | Isono et al. | 347/213 |
| 6,899,478 | B1 * | 5/2005 | Mucelli et al. | 400/105 |
| 2002/0051027 | A1 * | 5/2002 | Kyogoku et al. | 347/19 |
| 2002/0135631 | A1 * | 9/2002 | Sasaki et al. | 347/19 |
| 2002/0180993 | A1 | 12/2002 | Klinefelter | |
| 2003/0030833 | A1 | 2/2003 | Mochizuki | |
| 2005/0140769 | A1 * | 6/2005 | Kanemaru et al. | 347/172 |

FOREIGN PATENT DOCUMENTS

| | | |
|---|---|---|
| JP | 62-163191 | 7/1987 |
| TW | 434474 | 5/2001 |

* cited by examiner

*Primary Examiner*—K. Feggins
(74) *Attorney, Agent, or Firm*—Winston Hsu; Scott Margo

(57) ABSTRACT

Thermal sublimation card printers and associated method for printing image onto a card are disclosed. One proposed method includes receiving target image data; moving a card; transferring dyes of a ribbon onto the card according to the target image data while moving the card; detecting the movement of the card; when the card has moved a predetermined distance, determining image characteristics corresponding to remaining image data of the target image data that has not printed yet; determining image content to be printed onto remaining area of the card according to determined image characteristics; and transferring dyes of the ribbon onto the remaining area of the card according to the image content.

32 Claims, 5 Drawing Sheets

THERMAL SUBLIMATION CARD PRINTERS AND ASSOCIATED METHOD FOR PRINTING IMAGE ONTO CARD

BACKGROUND OF THE INVENTION

1. Field of the Invention

The invention relates to a thermal sublimation printing technique, and more particularly, to a thermal sublimation card printer and associated method for printing images onto a card.

2. Description of the Prior Art

Thermal sublimation (or thermal transfer) printers have become increasingly popular due to their excellent full tone printing performance. A thermal sublimation printer drives uses a thermal print head (TPH) to heat a ribbon containing dyes for transferring the dyes onto an object to be printed. In this way, continuous-tone can be formed on the object according to the heating time or the heating temperature.

A thermal sublimation card printer capable of printing images onto all kinds of cards such as business cards, entrance cards or membership cards is developed to satisfy market requirements. A conventional thermal sublimation card printer primarily utilizes a transmission such as a roller to move a card to the thermal print head's position and then utilizes the thermal print head to transfer the dyes from the ribbon onto the card. After transferring the dyes of one color, the transmission mechanism will move the card back to the original position so as to perform a next dye transferring operation of another color.

However, the card's position often deviates from the desired position due to hardware assembly inaccuracy. This therefore results in the existence of an unwanted blank area or the thermal print head of the thermal sublimation card printer performing the printing operation in an area outside the card. The former may decrease the output image quality and the latter may cause the ribbon to break. For example, if the card's position is far behind the ideal position, the thermal print head will start printing an area before a front edge of the card, whereas if the card's position is far ahead of the desired position, the thermal print head will print an area after the rear edge of the card.

Because the card is thicker than conventional paper, if the thermal print head starts to print before the front edge of the card or keeps printing after the rear edge of the card, the ribbon could break when the thermal print head is just about to contact with the card or depart from the edge of the card since the friction force between the card and the thermal print head changes rapidly.

In addition to the above-mentioned hardware assembly inaccuracy, the color contents of the output image also affect the position where the thermal print head finishes printing. For example, the deeper the color of the output image, the greater the tension force when the ribbon departs from the card. This causes the ribbon to push the card forward, resulting in the card's moving speed or distance exceeding a predetermined value. In this way, there is a higher possibility that the ribbon breaks since the thermal print head may keep printing after the rear edge of the card. The above-mentioned problem occurs more frequently when a full size printing is performed.

SUMMARY OF THE INVENTION

It is therefore one of the objectives of the claimed invention to provide a thermal sublimation card printer and related card printing method, to solve the above-mentioned problem.

According to an exemplary embodiment of the claimed invention, a method applied to a thermal sublimation card printer for printing images onto a card is disclosed. The method comprises: receiving a target image data; moving a card; transferring dyes of a ribbon onto the card according to the target image data while moving the card; detecting a movement of the card; when the card has been moved by a predetermined distance, determining image characteristics corresponding to remaining image data of the target image data that has not been printed yet; determining image contents to be printed onto a remaining area of the card according to the determined image characteristics; and transferring dyes of the ribbon onto the remaining area of the card according to the image contents.

According to another exemplary embodiment of the claimed invention, a thermal sublimation card printer is disclosed. The thermal sublimation card printer comprises: a card actuator, for moving a card; a thermal print head; a controlling unit, coupled to the thermal head, for receiving a target image data and transferring dyes of a ribbon onto the card according to the target image data while the car actuator is moving the card; and a sensing device, coupled to the controlling unit, for detecting a movement of the card; wherein when the card has been moved by a predetermined distance, the controlling unit determines image characteristics corresponding to a remaining image data of the target image data that has not been printed yet, determines image contents to be printed onto a remaining area of the card according to the determined image characteristics, and then transfers dyes of the ribbon onto the remaining area of the card according to the image contents.

According to yet another exemplary embodiment of the claimed invention, a method applied to a thermal sublimation card printer for printing images onto a card is also disclosed. The card printing method comprises: receiving a target image data; moving a card; transferring dyes of a ribbon onto the card according to the target image data while moving the card; detecting a movement of the card; when an operation of transferring dyes of the ribbon onto the card has been processed for a predetermined period of time, determining image characteristics corresponding to a remaining image data of the target image data that has not been printed yet; determining image contents to be printed onto a remaining area of the card according to the determined image characteristics; and transferring dyes of the ribbon onto the remaining area of the card according to the image content.

According to still another exemplary embodiment of the claimed invention, a thermal sublimation card printer is also disclosed. The thermal sublimation card printer comprises: a card actuator, for moving a card; a thermal print head; and a controlling unit, coupled to the thermal head, for receiving a target image data and transferring dyes of a ribbon onto the card according to the target image data while the card actuator is moving the card; wherein when an operation of transferring dyes of the ribbon onto the card has been processed until a predetermined period of time, the controlling for determining image characteristics corresponding to a remaining image data of the target image data that has not been printed yet, determines image contents to be printed onto a remaining area of the card according to the determined image characteristics, and transfers dyes of the ribbon onto the remaining area of the card according to the image contents.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
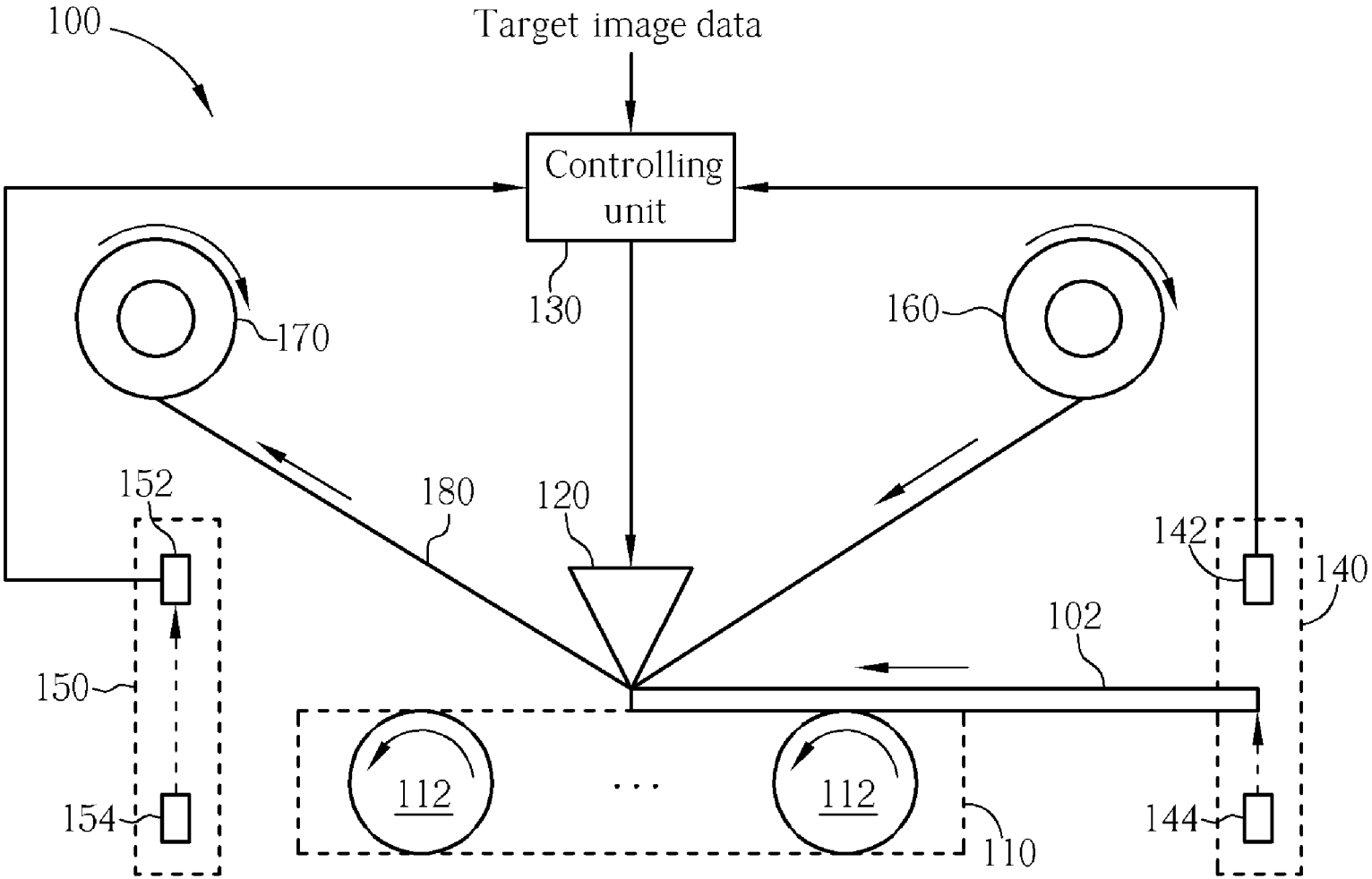
FIG. 1 is a simplified diagram illustrating a thermal sublimation card printer according to a first embodiment of the present invention.

Please refer to FIG. 1. FIG. 1 is a simplified diagram illustrating a thermal sublimation card printer 100 according to a first embodiment of the present invention. As shown in FIG. 1, the thermal sublimation card printer 100 comprises a card actuator 110, a thermal print head 120, a controlling unit 130, a first sensing device 140, a second sensing device 150, a ribbon supply end 160, and a ribbon retrieving end 170. In this embodiment, the card actuator 110 has a plurality of rollers 112 for moving a card 102 to be printed in a predetermined direction. Also, the card actuator 110 could be provided with an appropriate number of auxiliary rollers, bearing rollers, and other such mechanisms (not shown) so as to ensure that the card 102 moves in the predetermined direction smoothly and steadily.

In the thermal sublimation card printer 100, the first sensing device 140 and the second sensing device 150 are implemented for detecting a movement of the card 102. As shown in FIG. 1, the first sensing device 140 has a light sensor 142 and a light emitting component 144; and the second sensing device 150 has a light sensor 152 and a light emitting component 154. The light emitting components 144, 154 could be implemented by light emitting diodes (LED), electroluminescence (EL) components, and so on.

When printing the card 102, the ribbon supply end 160 transports a ribbon 180 in the direction toward the thermal print head 120, and the controlling unit 130 controls the thermal print head 120 to heat the ribbon 180 containing dyes so as to transfer the dyes to the card 102 for printing images. In color printing applications, the ribbon 180 has different color dye regions arranged in order. The dye regions are cyclically arranged in the order of yellow dye, magenta dye, cyan dye and overcoating dye. The ribbon retrieving end 170 retrieves a ribbon which has been used by the thermal print head 120. In practice, the ribbon supply end 160 and ribbon retrieving end 170 could be implemented by rollers, but this should not be taken as a limitation of the present invention. Further description of the operation of the thermal sublimation card printer 100 is as below, with reference to FIG. 2 and FIG. 3.

Figure 2:
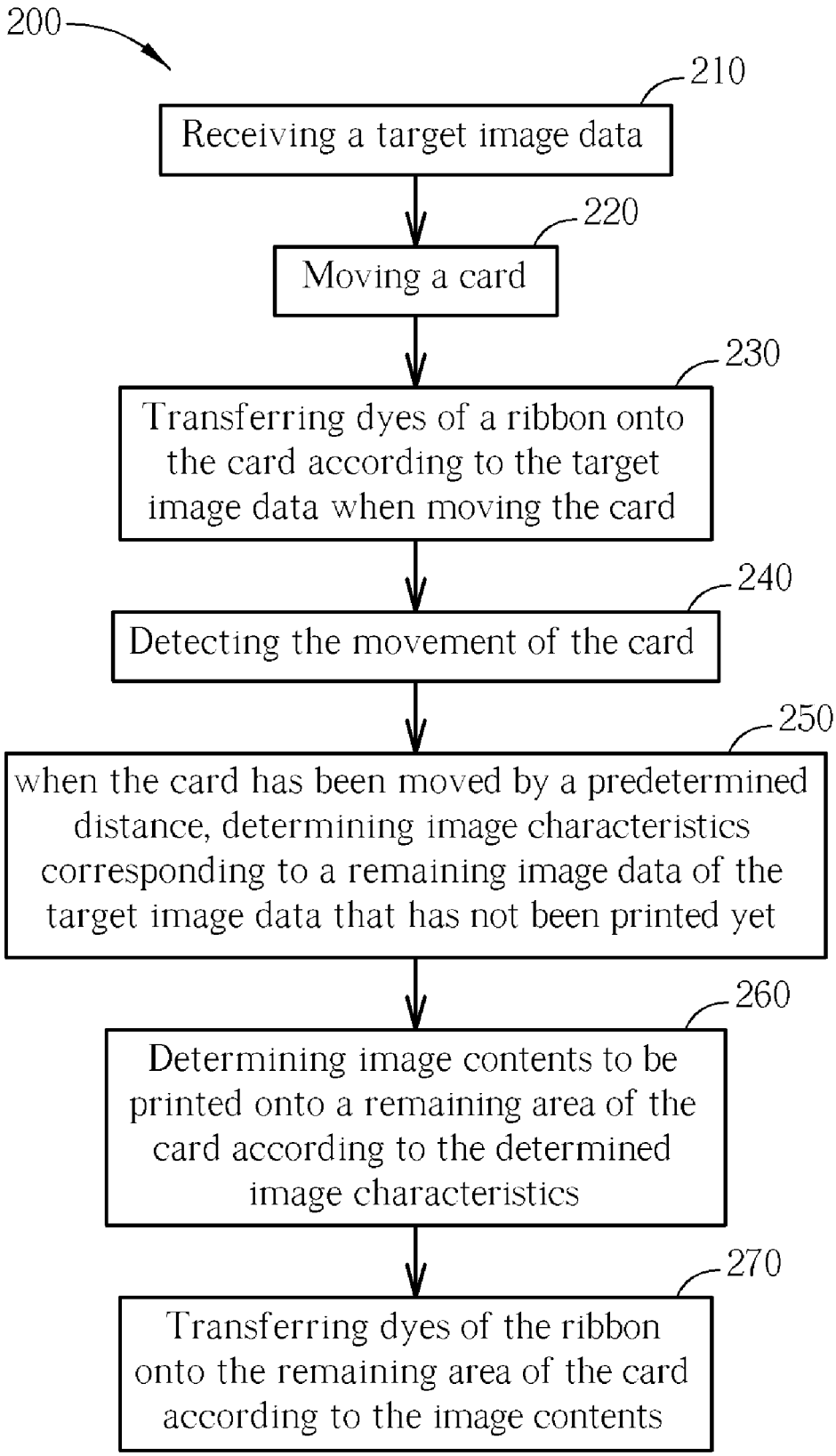
FIG. 2 is a flow chart illustrating a card printing method using thermal sublimation technique according to the first embodiment of the present invention.

FIG. 2 is a flow chart 200 illustrating the card printing method using thermal sublimation technique according to the first embodiment of the present invention. The transferring processes of the color dyes on the ribbon 180 are similar; for clear illustration therefore, only one example of a color transferring operation is given (as below). The flow chart 200 includes the following steps.

In step 210, the controlling unit 130 of the thermal sublimation card printer 100 receives a target image data corresponding to the image to be printed to the card 102.

In step 220, the card actuator 110 moves the card 102 in a direction toward the thermal print head 120. Firstly, the card 102 blocks the light emitted from the light emitting component 144 to prevent it from reaching the light sensor 142 in the first sensing device 140. Until the rear edge of the card 102 has moved past the position between the light sensor 142 and the light emitting component 144, the light emitted from the light emitting component 144 is not blocked and can be sensed by the light sensor 142. At this time, the light sensor 142 generates a signal to the controlling unit 130; the controlling unit 130 then determines that the card 102 is moved to a printing position according to the signal. Please note that numbers of the light sensor and light emitting components of the first sensing device 140 are not limited to the embodiment shown in FIG. 1. Additionally, the first sensing device 140 could be designed to detect the front edge of the card 102 for determining if the card 102 is moved to a printing position.

Next, the controlling unit 130 will perform step 230. The controlling unit 130 controls the thermal print head 120 to transfer dyes of the ribbon 180 onto the card 102 according to the received target image data when the card actuator 110 moves the card 102. Only when the card 102 is at the printing position and ready to be printed, will the controlling unit 130 control the thermal print head 120 to start to print; therefore, the situations where an unwanted blank area exists or the thermal print head 120 starts to print before the front edge of the card 102 can be avoided.

Additionally, when the thermal print head 120 is printing the card 102 (namely, the controlling unit 130 is performing step 230), the second sensing device 150 will perform step 240 to detect the movement of the card 102. As shown in FIG. 1, before the front end of the card 102 reaches the detecting position of the second sensing device 150, the light detector 152 of the second sensing device 150 is capable of detecting the light emitted from the light emitting component 154.

Figure 3:
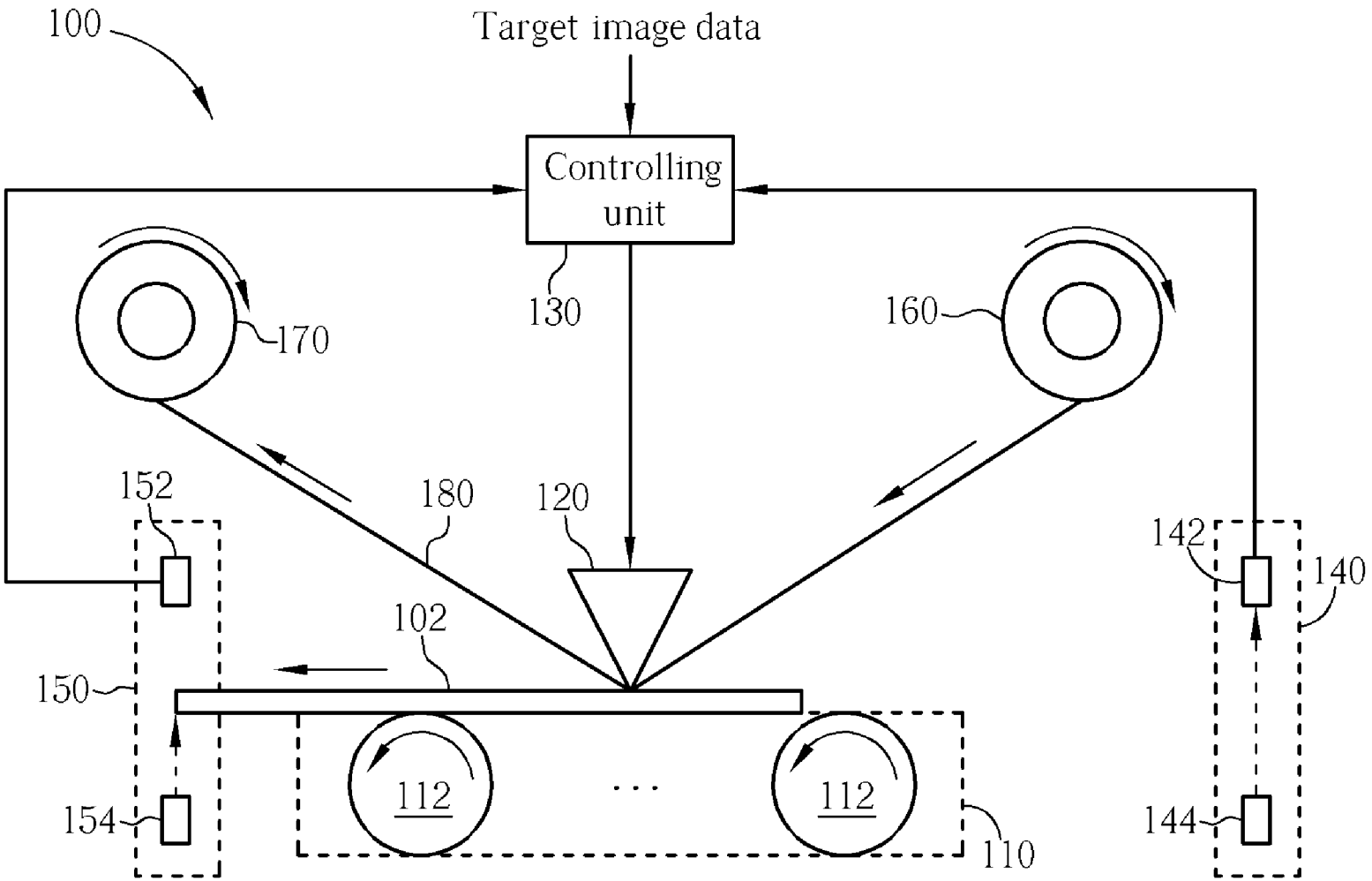
FIG. 3 is a diagram illustrating a card in the thermal sublimation card printer shown in FIG. 1 moving a predetermined distance.

As shown in FIG. 3, when the front edge of the card 102 reaches the position between the light sensor 152 and the light emitting component 154, the light emitted from the light emitting component 154 will be blocked by the card 102 and cannot be detected by the light sensor 152. At this time, the light sensor 152 generates a signal to the controlling unit 130; then the controlling unit 130 determines that the card 102 reaches a predetermined position according to the signal. From the above-mentioned illustration, it can be known that controlling unit 130 is able to determine if the card 102 has moved a predetermined distance from the printing position according to the detecting result given by the second sensing device 150. Please note that numbers of the light sensor and light emitting components of the second sensing device 150 are not limited to the embodiment shown in FIG. 1. Additionally, the second sensing device 150 could be designed to detect the rear edge of the card 102 for detecting the movement of the card 102. In practice, the predetermined distance could be set to be a certain ratio of the total length of the card 102, for example 2:3, 3:4, 9:10, etc. Preferably, the predetermined distance is defined to be in a range from 4:5 to 5:6 of the total length of the card 102.

When the controlling unit 130 determines that the card 102 has been moved by the predetermined distance, the controlling unit 130 will perform step 250 for determining image characteristics corresponding to a remaining image data of the target image data that has not been printed yet. For example, the controlling unit 130 can perform a statistics operation on the remaining image data of the target image data that has not been printed yet to thereby determine image characteristics corresponding to the remaining image data, such as calculating an average image value of the remaining image data (e.g. an average gray level, average color value, and so on) or calculating the total number of the pixels whose gray level or color value exceeds a predetermined threshold value. The above-mentioned statistics operations are only examples for illustration and are not meant to be limitations of the present invention.

In step 260, the controlling unit 130 will determine image contents to be printed onto a remaining area of the card 102 according to the determined image characteristics. Next, the controlling unit 130 will perform step 270 to control the thermal print head 120 to transfer dyes of the ribbon 180 onto the remaining area of the card 102 according to the image contents.

For clear illustration, suppose that the controlling unit 130 calculates the average gray level of the remaining image data in step 250. If the average gray level is less than a first threshold value (e.g. 90), the controlling unit 130 will decrease an image column number of the remaining image data in step 260. For example, the controlling unit 130 can discard at least one image column in a back sector of the remaining image data (e.g. one or a plurality of image columns in the end of the remaining image data) so as to decrease the image column number of the remaining image data. In one embodiment, the image column number decreased by the controlling unit 130 is inversely proportional to the average gray level of the remaining image data; in other words, the lower the average gray level of the remaining image data, the more the image column number is decreased by the controlling unit 130. For example, the relation between the image column number decreased by the controlling unit 130 and the average gray level of the remaining image data could be a linear function, a curve function, or a piece-wise linear function.

In another embodiment, the relation between the image column number decreased by the controlling unit 130 and the average gray level of the remaining image data is a step function in order to decrease the control complexity. For example, when the average gray level of the remaining image data falls in a range from 61 to 90, the controlling unit 130 will discard one image column of the remaining image data; when the average gray level of the remaining image data falls in a range from 31 to 60, the controlling unit 130 will discard two image columns of the remaining image data; and when the average gray level of the remaining image data falls in a range from 0 to 30, the controlling unit 130 will discard three image columns of the remaining image data.

In step 270, the controlling unit 130 controls the thermal print head 120 to transfer dyes of the ribbon 180 onto the remaining area of the card 102 according to the remaining image data with decreased image column number so as to prevent the ribbon 180 from breaking due to the situation where the thermal print head 120 keeps printing after the rear edge of the card 102.

If the controlling unit 130 determines that the average gray level is greater than a second threshold vale (e.g. 210) in step 250, the controlling unit 130 will increase the image column number of the remaining image data in step 260. For example, the controlling unit 130 can interpolate at least one image column in the back sector of the remaining image data so as to increase the image column number of the remaining image data. In practice, the controlling unit 130 can copy the last image column of the remaining image data and add the copied image column to the end of the remaining image data so as to increase the image column number of the remaining image data. In one embodiment, the image column number increased by the controlling unit 130 is directly proportional to the average gray level of the remaining image data; in other words, the higher the average gray level of the remaining image data, the more the image column number is increased by the controlling unit 130. For example, the relation between the image column number increased by the controlling unit 130 and the average gray level of the remaining image data could be a linear function, a curve function, or a piece-wise linear function.

In another embodiment, the relation between the image column number increased by the controlling unit 130 and the average gray level of the remaining image data is a step function in order to decrease the control complexity. For example, when the average gray level of the remaining image data falls in a range from 210 to 230, the controlling unit 130 will add one image column of the remaining image data; and when the average gray level of the remaining image data falls in a range from 231 to 255, the controlling unit 130 will add two image columns of the remaining image data.

In step 270, the controlling unit 130 controls the thermal print head 120 to transfer dyes of the ribbon 180 onto the remaining area of the card 102 according to the remaining image data with increased image column number, so as to prevent the occurrence of the unwanted blank area in the rear edge of the card 102, thereby improving the output image quality.

Please note that the execution order shown in the flow chart 200 is only for illustrative purposes and should not be taken as a limitation of the present invention. For example, the steps 220, 230, 240 can be performed at the same time in practice.

Figure 4:
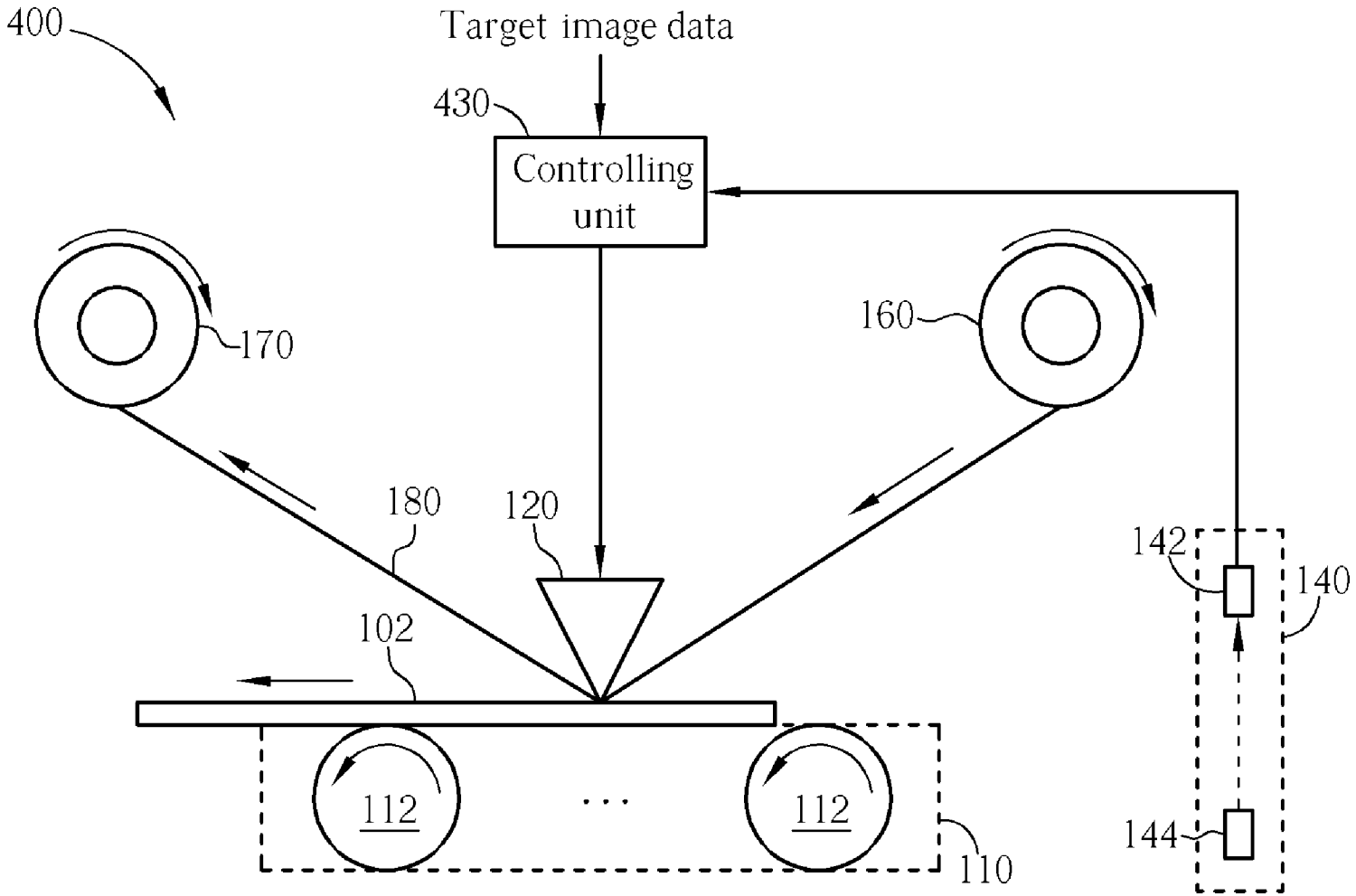
FIG. 4 is a simplified diagram illustrating a thermal sublimation card printer according to a second embodiment of the present invention.

Please refer to FIG. 4. FIG. 4 is a simplified diagram illustrating a thermal sublimation card printer 400 according to a second embodiment of the present invention. Because the thermal sublimation card printer 400 shown in FIG. 4 is similar to the thermal sublimation card printer 100 disclosed before, the components having the same operation are labeled with the same reference numeral for simplicity and clarity. The key difference between the thermal sublimation card printer 400 and the thermal sublimation card printer 100 is that the second sensing device 150 mentioned above is omitted in the thermal sublimation card printer 400. Further description of the operation of the thermal sublimation card printer 400 is as below. Please refer to FIG. 5.

Figure 5:
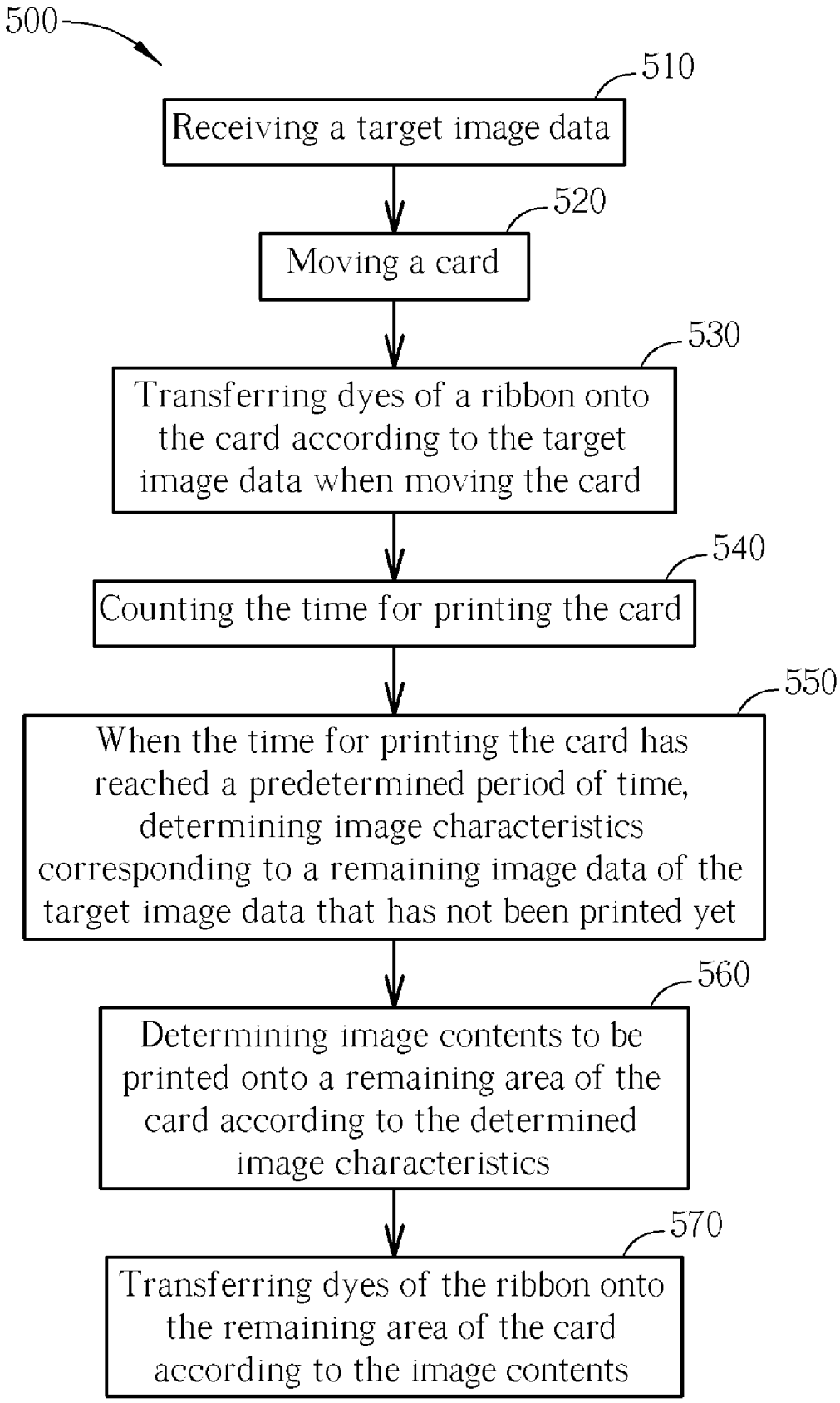
FIG. 5 is a flow chart illustrating a card printing method using thermal sublimation technique according to the second embodiment of the present invention.

FIG. 5 is a flow chart 500 illustrating a card printing method using a thermal sublimation technique according to a second embodiment of the present invention. The steps 510, 520, 530, 560, and 570 in the flow chart 500 are substantially the same as the steps 210, 220, 230, 260, and 270 mentioned previously, so the description of the steps are omitted here for brevity.

Because the second sensing device 150 mentioned above is omitted in the thermal sublimation card printer 400, when the thermal print head 120 prints the card 102 (namely, in step 530), the controlling unit 430 of the thermal sublimation card printer 400 will perform step 540 to count the operation time in which the thermal print head 120 transfers dyes of the ribbon 180 onto the card 102; namely, to count the time in which the thermal print head 120 prints the card 102. The controlling unit 430 can make use of all kinds of available methods to count the operation time in which the thermal print head 120 prints the card 102 in step 430, and the method for counting the operation time is not limited to a specific method.

When the thermal print head 120 has printed the card 102 for a predetermined period of time, the controlling unit 430 will perform step 550 to determine image characteristics corresponding to remaining image data of the target image data that has not been printed yet. In practice, the predetermined period of time could be set to be a certain ratio of the total time needed by the thermal print head 120 for printing all of the image columns of the target image data, such as 2:3, 3:4, 9:10, and so on. In a preferred embodiment, the predetermined period of time is set to be a fixed ratio in a range from 4:5 to 5:6 of the total time needed for printing all of the image columns of the target image data.

As in the controlling unit 130 mentioned above, the controlling unit 430 then determines image contents to be printed onto a remaining area of the card 102 according to the determined image characteristics in step 560, and controls the thermal print head 120 to transfer dyes of the ribbon 180 onto the remaining area of the card 102 according to the image contents.

Briefly summarized, the above-mentioned method for printing a card includes: when the thermal sublimation printer has printed the card for a period of time (e.g., the card has been moved by a predetermined distance, or the printer has printed the card for a predetermined period of time), determining image characteristics corresponding to remaining image data that have not been printed yet, and compensating the image content to be printed onto the remaining area of the card according to the determined image characteristics, in order to prevent the ribbon from breaking due to the situation where the thermal print head keeps printing after the rear edge of the card, and/or to prevent the occurrence of the unwanted blank area at the rear section of the card.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method applied to a thermal sublimation card printer for printing images onto a card, the method comprising:

receiving a target image data;

moving a card;

transferring dyes of a ribbon onto the card according to the target image data while moving the card;

detecting a movement of the card;

when the card has been moved by a predetermined distance, determining image characteristics corresponding to remaining image data of the target image data that have not been printed yet;

determining image contents to be printed onto a remaining area of the card according to the determined image characteristics; and transferring dyes of the ribbon onto the remaining area of the card according to the image contents.

2. The method of claim 1, wherein the step of determining image characteristics corresponding to remaining image data of the target image data comprises:

calculating an average image value of the remaining image data.

3. The method of claim 2, wherein the average image value is an average gray level.

4. The method of claim 2, wherein the step of determining the image contents to be printed onto the remaining area of the card comprises:

if the average image value is less than a first threshold vale, decreasing an image column number of the remaining image data.

5. The method of claim 4, wherein the step of decreasing the image column number of the remaining image data comprises:

discarding at least one image column in a back sector of the remaining image data.

6. The method of claim 2, wherein the step of determining the image contents to be printed onto the remaining area of the card comprises:

if the average image value is greater than a second threshold value, increasing an image column number of the remaining image data.

7. The method of claim 6, wherein the step of increasing the image column number of the remaining image data comprises:

interpolating at least one image column in a back sector of the remaining image data.

8. The method of claim 7, wherein the interpolated image column is substantially the same as a last image column of the remaining image data.

9. The method of claim 1, wherein the step of determining image characteristics corresponding to the remaining image data comprises performing a statistics operation on the remaining image data, and the step of determining the image contents to be printed onto the remaining area of the card comprises:

adjusting an image column number according to a result of the statistics operation.

10. A thermal sublimation card printer, comprising:

a card actuator, for moving a card;

a thermal print head;

a controlling unit, coupled to the thermal head, for receiving a target image data and transferring dyes of a ribbon onto the card according to the target image data while the card actuator is moving the card; and a sensing device, coupled to the controlling unit, for detecting a movement of the card; wherein when the card has been moved by a predetermined distance, the controlling unit determines image characteristics corresponding to a remaining image data of the target image data that has not been printed yet, determines image contents to be printed onto a remaining area of the card according to the determined image characteristics, and then transfers dyes of the ribbon onto the remaining area of the card according to the image contents.

11. The thermal sublimation card printer of claim 10, wherein the controlling unit determines the image characteristics corresponding to the remaining image data of the target image data that has not been printed yet by calculating an average image value of the remaining image data.

12. The thermal sublimation card printer of claim 11, wherein the average image value is an average gray level.

13. The thermal sublimation card printer of claim 11, wherein if the average image value is less than a first threshold vale, the controlling unit will decrease an image column number of the remaining image data.

14. The thermal sublimation card printer of claim 13, wherein the controlling unit discards at least one image column in a back sector of the remaining image data to decrease the image column number of the remaining image data.

15. The thermal sublimation card printer of claim 11, wherein if the average image value is greater than a second threshold value, the controlling unit will increase an image column number of the remaining image data.

16. The thermal sublimation card printer of claim 15, wherein the controlling unit interpolates at least one image column in a back sector of the remaining image data to increase the image column number of the remaining image data.

17. The thermal sublimation card printer of claim 16, wherein the interpolated image column is substantially the same as a last image column of the remaining image data.

18. The thermal sublimation card printer of claim 10, wherein the controlling unit performs a statistics operation on the remaining image data, and adjusts an image column number according to a result of the statistics operation.

19. A method applied to a thermal sublimation card printer for printing images onto a card, the method comprising:

receiving a target image data;

moving a card;

transferring dyes of a ribbon onto the card according to the target image data while moving the card;

detecting a movement of the card;

when an operation of transferring dyes of the ribbon onto the card has been processed for a predetermined period of time, determining image characteristics corresponding to a remaining image data of the target image data that has not been printed yet;

determining image contents to be printed onto a remaining area of the card according to the determined image characteristics; and transferring dyes of the ribbon onto the remaining area of the card according to the image contents.

20. The method of claim 19, wherein the step of determining the image characteristics corresponding to the remaining image data of the target image data comprises:

calculating an average image value of the remaining image data.

21. The method of claim 20, wherein the step of determining the image contents to be printed onto the remaining area of the card comprises:

if the average image value is less than a first threshold vale, decreasing an image column number of the remaining image data to obtain an adjusted remaining image data.

22. The method of claim 21, wherein the step of decreasing the image column number of the remaining image data comprises:

discarding at least one image column in a back sector of the remaining image data.

23. The method of claim 20, wherein the step of determining the image contents to be printed onto the remaining area of the card comprises:

if the average image value is greater than a second threshold value, increasing an image column number of the remaining image data to obtain an adjusted remaining image data.

24. The method of claim 23, wherein the step of increasing the image column number of the remaining image data comprises:

interpolating at least one image column in a back sector of the remaining image data.

25. The method of claim 19, wherein the step of determining the image characteristics corresponding to the remaining image data comprises performing a statistics operation on the remaining image data, and the step of determining the image contents to be printed onto the remaining area of the card comprises:

adjusting an image column number according to a result of the statistics operation.

26. A thermal sublimation card printer, comprising:

a card actuator, for moving a card;

a thermal print head; and a controlling unit, coupled to the thermal head, for receiving a target image data and transferring dyes of a ribbon onto the card according to the target image data while the card actuator is moving the card;

wherein when an operation of transferring dyes of the ribbon onto the card has been processed for a predetermined period of time, the controlling unit determines image characteristics corresponding to a remaining image data of the target image data that has not been printed yet, determines image contents to be printed onto a remaining area of the card according to the determined image characteristics, and transfers dyes of the ribbon onto the remaining area of the card according to the image contents.

27. The thermal sublimation card printer of claim 26, wherein the controlling unit determines the image characteristics corresponding to the remaining image data of the target image data that has not been printed yet by calculating an average image value of the remaining image data.

28. The thermal sublimation card printer of claim 27, wherein if the average image value is less than a first threshold vale, the controlling unit will decrease an image column number of the remaining image data to obtain an adjusted remaining image data.

29. The thermal sublimation card printer of claim 28, wherein the controlling unit discards at least one image column in a back sector of the remaining image data to decrease the image column number of the remaining image data.

30. The thermal sublimation card printer of claim 27, wherein if the average image value is greater than a second threshold vale, the controlling unit will increase an image column number of the remaining image data to obtain an adjusted remaining image data.

31. The thermal sublimation card printer of claim 30, wherein the controlling unit interpolates at least one image column in a back sector of the remaining image data to increase the image column number of the remaining image data.

32. The thermal sublimation card printer of claim 26, wherein the controlling unit performs a statistics operation on the remaining image data, and adjusts an image column number according to a result of the statistics operation.

* * * * *